US008479460B1

(12) United States Patent
Meyer

(10) Patent No.: US 8,479,460 B1
(45) Date of Patent: Jul. 9, 2013

(54) HIGH SHEAR ROOF DECK SYSTEM

(75) Inventor: Brian J. Meyer, Columbia, SC (US)

(73) Assignee: Consolidated Systems, Inc., Columbia, SC (US)

( * ) Notice: Subject to any disclaimer, the term of this patent is extended or adjusted under 35 U.S.C. 154(b) by 250 days.

(21) Appl. No.: 12/857,188

(22) Filed: Aug. 16, 2010

Related U.S. Application Data

(60) Provisional application No. 61/234,666, filed on Aug. 18, 2009.

(51) Int. Cl.
*E04F 11/16* (2006.01)

(52) U.S. Cl.
USPC ..... 52/177; 52/336

(58) Field of Classification Search
USPC ..... 52/177, 783.11, 798.1, 650.3, 336, 52/838
See application file for complete search history.

(56) References Cited

U.S. PATENT DOCUMENTS 1,906,683 A * 5/1933 Weiskopf ..... 52/838
3,093,932 A * 6/1963 Dreier et al. ..... 52/127.3
3,218,773 A * 11/1965 Heirich ..... 52/521
3,372,523 A * 3/1968 Hall, Jr. ..... 52/699
3,600,868 A * 8/1971 Wilson et al. ..... 52/334
3,683,580 A * 8/1972 McManus ..... 52/334
4,120,131 A * 10/1978 Carroll ..... 52/310
4,259,822 A * 4/1981 McManus ..... 52/334
4,416,099 A * 11/1983 Fiergolla et al. ..... 52/319
4,747,249 A * 5/1988 Bell et al. ..... 52/543
4,882,883 A * 11/1989 Horn ..... 52/79.1
5,390,466 A * 2/1995 Johnson et al. ..... 52/783.14
5,605,423 A * 2/1997 Janusz ..... 411/387.6

* cited by examiner

*Primary Examiner* — Basil Katcheves
(74) *Attorney, Agent, or Firm* — Michael A. Mann; Nexsen Pruet, LLC

(57) ABSTRACT

A deck system includes plural deck units fastened together and carried directly by the framing system of a building directly or indirectly by frame elements that are themselves carried by the framing system. To relieve lateral forces on the deck system that exceed a pre-engineered level, these frame elements include a slidable support and slidable brackets both with slotted holes that permit controlled and limited movement of the deck system in two mutually orthogonal directions with respect to the framing system of the building. In addition, the individual deck units may move horizontally with respect to the each other and the framing system. Each decking unit may be connected to an adjacent decking unit using a slotted hole formed in one of its two side laps.

14 Claims, 3 Drawing Sheets

HIGH SHEAR ROOF DECK SYSTEM

PRIORITY CLAIM

The priority benefit of U.S. provisional patent application No. 61/234,666, filed Aug. 18, 2009, and which is incorporated herein in its entirety by reference, is claimed.

BACKGROUND OF THE INVENTION

In some parts of the world, buildings are subject to high winds or seismic events or both. In the United States, high winds and seismic events are particularly prevalent in California, near the coast along the Gulf of Mexico and in parts of the east coast. The forces produced by winds and earthquakes subject buildings and their roof framing systems to extreme lateral loads.

It is vital in the design of buildings in these areas, particularly in configuring their framing systems, which include the top chords of large truss systems and girders, to reduce the forces on the frame elements caused by these excessive lateral loads on a deck system supported by the building's framing system.

SUMMARY OF THE INVENTION

Briefly, and according to its major aspects, the present invention is a deck system for use with the framing system of a building, The deck system reduces the transfer of excessive lateral loads on the deck system, from high winds and seismic events for example, to that framing system. The deck system includes deck units carried directly by the framing system. These deck units are connected to each other in such a way that lateral forces on them that exceed a pre-engineered level cause the deck units to move with respect to each other while remaining fastened to the framing system.

In an alternative preferred design, the deck system also includes frame elements carried by the building's framing system. The frame elements move with respect to the framing system of the building. These two alternative deck systems can be combined to provide deck units that move with respect to adjacent deck units supported by and fastened to framing elements that move with respect to the framing system of the building.

In the first embodiment of the present invention, slotted deck units are joined together to form a deck system that is attached to frame elements so that the deck units are able to move with respect to the frame elements in the direction of the slots and thus reduce some of the excessive lateral load that would otherwise be transferred to the building framing system. In the second embodiment, deck units, slotted or unslotted, are joined to each other and to slotted frame elements so that the resulting deck system is able to move horizontally in any direction when sufficient lateral loads are applied and thereby reduce excessive forces that would otherwise be transferred to the building's framing system while maintaining adequate uplift (vertical) strength at each frame element's attachment.

A feature of the present invention is the use of slots in the deck units and/or in the frame elements to allow limited, controlled horizontal movement of the deck system under excessive lateral loads. This limited, controlled movement reduces the forces on the building frame system and helps it to remain within its elastic limits.

Those skilled in the art of deck systems and diaphragm framing system design will appreciate these and other features and their advantages from a careful reading of the following Detailed Description of Preferred Embodiments accompanied by the drawings.

DETAILED DESCRIPTION OF PREFERRED EMBODIMENTS

Figure 1:
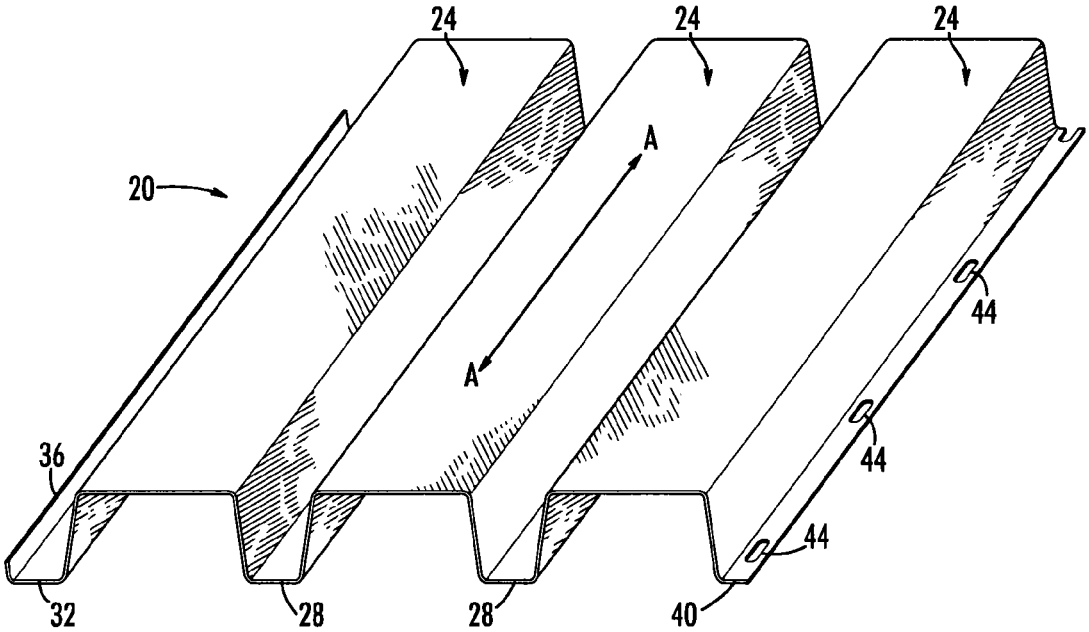
FIG. 1 is a perspective view of a deck unit according to a preferred embodiment of the present invention.

There are three embodiments of the present invention. In the first embodiment, the present invention is a deck system made of individual deck units fastened together and to the framing system of the building in such a way that the deck units respond to horizontal forces on the building by translational movement with respect to the framing system. In an alternative embodiment, deck units are fastened to frame elements rather than directly to the framing system of the building. The frame elements respond to horizontal forces on the deck system by translational movement. In this embodiment, the deck units and frame elements respond as a unit to the horizontal forces by translational movement with respect to the framing system.

The third embodiment is similar to the second embodiment but, in this case, the deck units may be fastened to the frame elements in the manner of the first embodiment, so that they respond to horizontal forces by translational movement with respect to the frame elements while the frame elements also respond to those forces by translational movement with respect to the framing system of the building. Translational movement is permitted and controlled by the use of slotted holes through the side laps of deck units and through the frame elements. Circular fasteners through these holes permit movement of the slotted deck units and slotted frame elements with respect to the structure to the framing system of the building.

The translational movement of the deck units in response to horizontal forces helps to reduce horizontal forces on the building so that the building is less likely to experience an inelastic deformation and thus the building design requirements for loads on the framing system may be correspondingly reduced.

The term "deck system" refers to a roof or floor. The deck system may include only deck units or a combination of deck units and frame elements, depending on the embodiment. A deck system will include plural deck units fastened together to form a single expanse for the floor or the roof. The term "deck unit" will be described in detail below but it is a single, integral profiled section of sheet metal that may be joined to other deck units to form the deck system.

The term "frame elements" will also be described more fully below but refers to structures intended to support deck units and to be interposed between the deck units and the framing system of the building in achieving the objects of the invention. Frame elements do not include the frame system of the balance of the building which provides primary support for the building structure. The frame system of the building, which is not part of the present invention, supports the building's walls and other deck systems, such as floors and ceilings not exposed to strong lateral loads. The framing system may include columns, girders and trusses.

The present deck system is designed to absorb the effects of lateral forces beyond a pre-engineered level by translational movement with respect to the building in order to reduce the transfer of lateral forces to the building frame system. Limited lateral forces will not exceed the building's pre-engineered threshold. Generally, that pre-engineered threshold will be based on a level of lateral force below that which would cause the building to deform inelastically. Moreover, by preventing the inelastic deformation of a building, the building is more likely to survive those lateral forces with no major structural damage.

The extent of the translational movement permitted by the present invention depends on the design criteria specific for the building, which is based in turn on the location of the building and on its environmental and engineering considerations. Once the present invention and its advantages are understood and incorporated into the design, the design is then subject to standard engineering analysis, and without undue experimentation, to assure that those criteria are satisfied.

The movement provided in the present invention is controlled and limited, based on slotted connections, which preferably allow lateral movement in one or more horizontal directions, and may allow movement in two mutually-orthogonal, horizontal directions, such as a first direction parallel to the deck span and a second direction perpendicular to the deck span, and combinations thereof. The first embodiment moves only parallel to the deck span; the second and third embodiments move in both orthogonal directions and in various combinations of the two directions.

Referring now to the drawings, FIG. 1 illustrates a deck unit 20 according to the present invention, which is a profiled, integral section of sheet metal, preferably steel, with at least one flat 24 and channels 28 between each pair of flats 24, if there is more than one flat 24. A "flat" is an inverted U-shaped form presenting a generally flat surface on top. Two adjacent flats 24 are separated by a channel 28. Flats 24 and channels 28 are made to run continuous with their major dimension parallel to a deck span, as indicated by direction A-A. In one embodiment, deck unit 20 may have three flats 24 and two corresponding channels 28, as shown in FIG. 1. Each deck unit 20 terminates in complementary, opposing sidelaps, a first side lap 32 shown with an upturned flange 36 and a second sidelap 40 without an upturned flange.

The shapes of first and second sidelaps 32, 40, are exemplary only. Other designs for sidelaps are possible with the present invention. A sidelap need only provide a face on each end of a deck unit 20 that can be used to fasten that side lap to a corresponding face of the sidelap of the adjacent deck unit 20. Preferably the two faces of adjacent deck units 20 overlap, and most preferably the overlapping faces are both horizontal and lie in a plane either directly on or above a surface to which the adjacent deck units 20 may be fastened such as the framing system of the building.

By fastening second side lap 40 of one deck unit 20 to first side lap 32 of any adjacent deck unit 20, a deck system of any practical extent can be formed given sufficient numbers of deck units 20 to attach.

Purely by way of example and not in limitation, a deck unit 20 may be eight inches running from the center of each channel 28 to the next channel 28, and each flat 24 may be three inches above channel 28. A first sidelap 32 may be 1.875 inches wide and a second sidelap 40 may be 1.000 inch wide that fits within first sidelap 32. This example serves to illustrate one possible combination of dimensions that may work together for a particular design criteria; many other combinations may be generated that will satisfy these and other design criteria.

Importantly, deck units 20 have slotted holes 44 formed at specified intervals in second sidelap 40. Each slotted hole 44 has a major dimension parallel to the major dimension of deck unit 20 and a minor dimension perpendicular to the major dimension of deck unit 20, i.e., with the major dimension of slotted hole 44 being parallel to deck span direction A-A. Slotted holes 44 may have a rectangular shape, a rectangular shape with rounded corners, or an oval shape. Holes 44 permit one side of a deck unit 20 to move with respect to the adjacent deck unit 20. The deck units 20 at the end of a deck system are fastened to the framing system of the building The spacing between slotted holes 44 and the length of each slotted hole 44 are dimensioned to meet the specific building design criteria. Slotted holes 44 permit one side of deck unit 20 to move essentially parallel to deck span direction A-A when sufficient lateral forces are applied to deck unit 20. By sliding, deck unit 20 yields in response to applied forces and thereby limits the transfer of those lateral forces to adjacent deck units 20 and ultimately to the underlying framing system of the building.

Figure 2A:
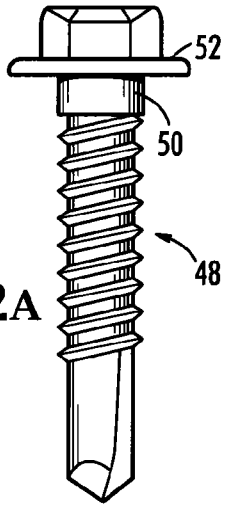
FIGS. 2A and 2B are a detailed side view of a first hexagonal head screw for insertion into a slotted sidelap of the deck unit of FIG. 1, and side, cross-sectional view of a second, alternative hexagonal head screw with a smooth bushing for insertion into a slotted side lap of the deck unit of FIG. 1, according to two alternative preferred embodiments of the present invention.

To attach the present deck unit 20 to an adjacent deck unit 20 along the length of its side laps 32, 40, mechanical fasteners such as screws or bolts are used. Two embodiments of mechanical fasteners useful for this purpose are shown, one in FIG. 2A and a different one in FIG. 2B. FIG. 2A shows a low-pitch threaded fastener 48 with washer 52 and non-threaded shoulder 50. Washer 52 and non-threaded shoulder 50 may be integral to fastener 48 as illustrated in FIG. 2A. An integrated washer 52 and non-threaded shoulder 50 with fastener 48 simplifies the installation, controls the translational movement and is the preferred method of attachment by design for that reason. Shoulder 50 of fastener 48 is smaller in diameter than the minor dimension of slotted holes 44 so that second side lap 40 of deck unit 20 can easily slide parallel to the direction of the deck span A-A with respect to first side lap 32. Washers 52 and threads of fastener 48, of course, prevent adjacent deck units 20 from separating or displacing with respect to each other vertically. Washers 52 distribute the pressure of fastener 48 to second side lap 40 over second side lap on either side of slotted hole 44. Thus, second side lap 40 deck unit 20 is able to slide in the direction of deck span A-A when a lateral force is applied while otherwise being securely held in place vertically to the adjacent deck unit 20.

Figure 2B:
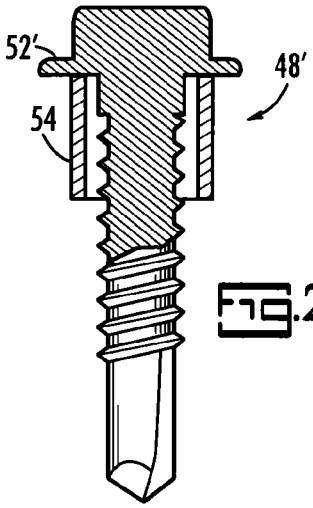

FIG. 2B illustrates in cross-section an alternate fastener 48' with integral washer 52' and a separate bushing 54. Bushing 54 provides the smooth surface for side lap 40 to slide with respect to side lap 32 of the adjacent deck unit 20.

Figure 3:
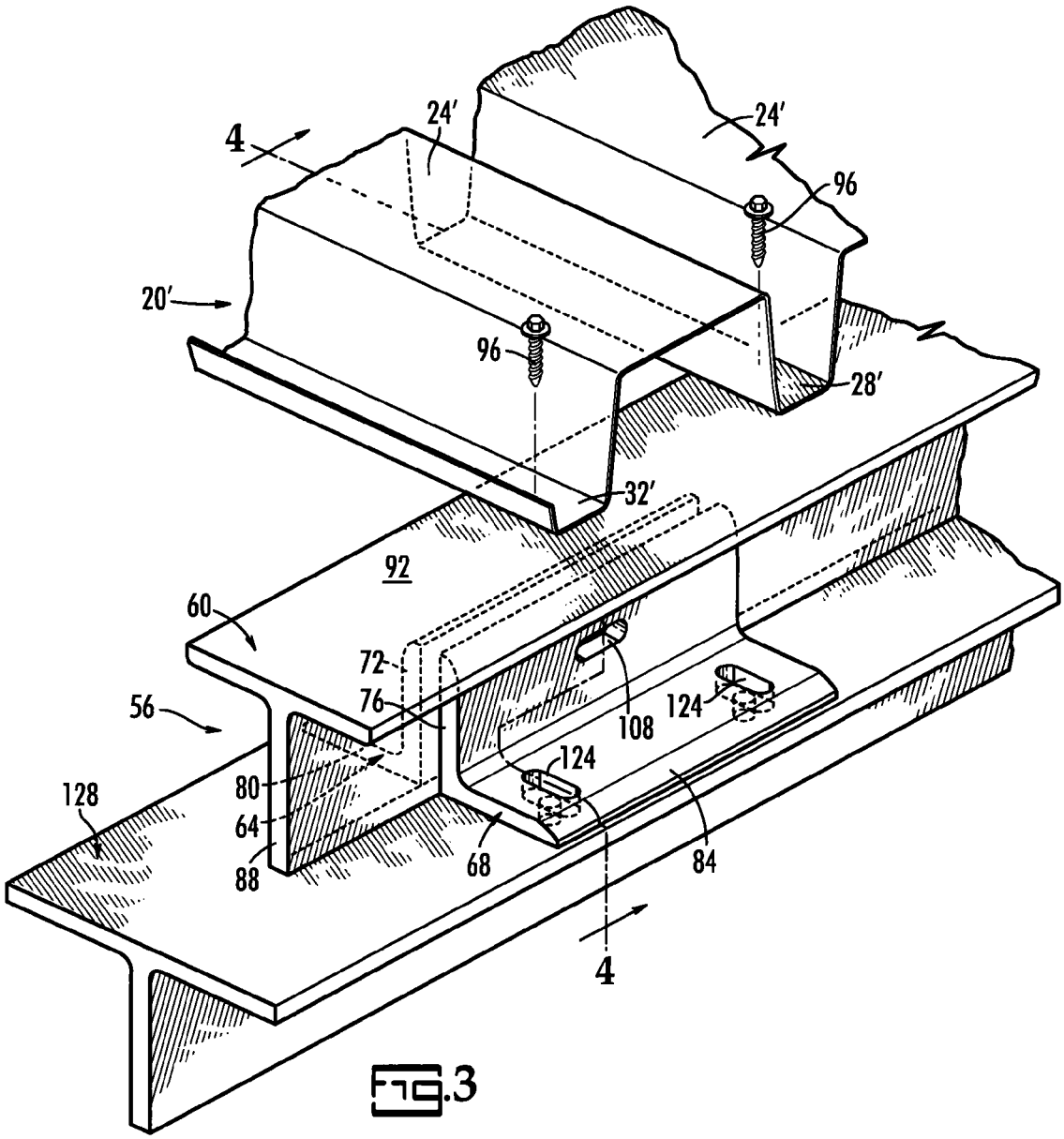
FIG. 3 is a perspective view of portion of a deck system, according to an alternative embodiment of the present invention.
Figure 4:
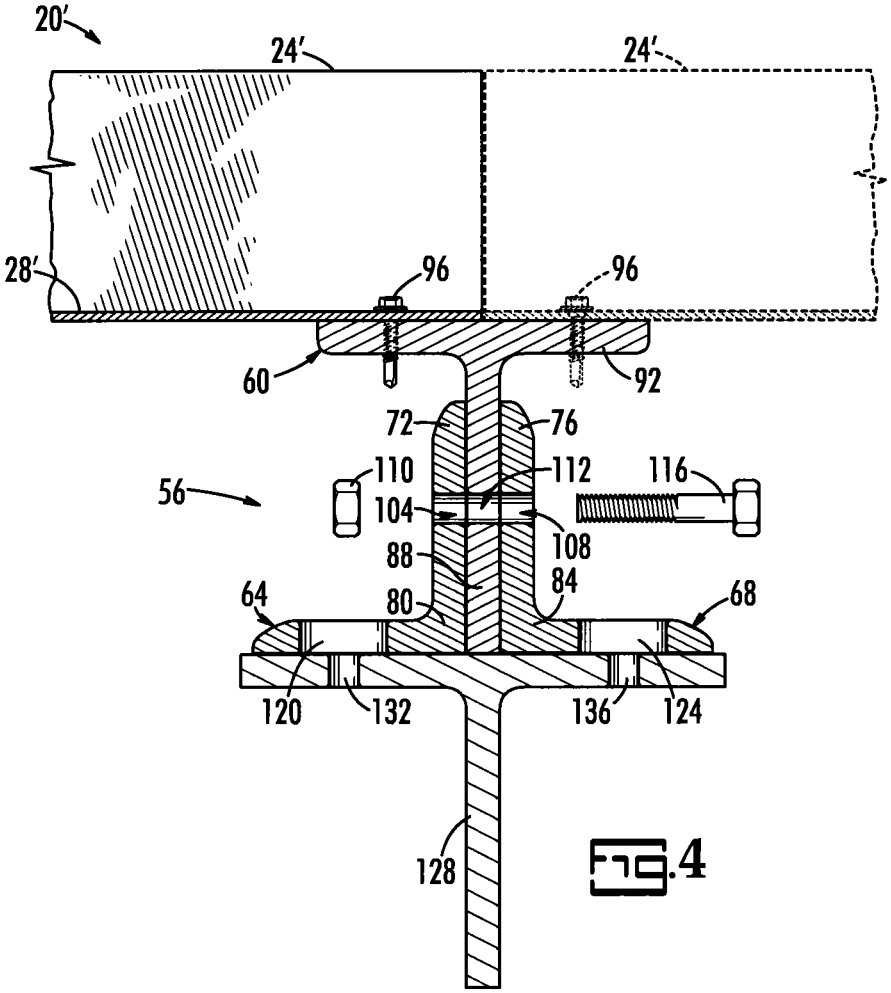
FIG. 4 is an end view of a portion of the deck system shown in FIG. 3, according to an alternative embodiment of the present invention.

FIGS. 3 and 4 illustrate frame element 56 and its relationship to deck unit 20'. Frame element 56 is a compound system interposed between a deck system and the framing system of a building and provides an alternative, and additional, way to relieve lateral forces on a building roof.

Deck unit 20' has flats 24' and channels 28' as well as opposing side laps, only first side lap 32' being shown in FIG. 3, but not slotted holes in the present embodiment.

Frame element 56 may include a T-support 60 riding between two spaced-apart angle brackets 64, 68. Angle brackets 64, 68 have vertical faces 72, 76, and integral horizontal faces 80, 84. Angle brackets 64 and 68 are oriented so that their respective vertical faces 72, 76 face each other and are spaced just far enough apart to allow a vertical member 88 of T-support 60 to slide longitudinally there between. A horizontal flange 92 is integral with vertical member 88 of T-support 60 and centered on vertical member 88 so as to give T-support 60 its T shape. Horizontal flange 92 rides above vertical faces 72, 76, without interference and forms a platform to which deck unit 20' is attached using one or more deck support fasteners 96 (i.e., pins, welds, and screws, for example). Deck support fasteners 96 are used to secure deck unit 20' through channel 28' to horizontal flange 92. T-support 60 thus supports deck unit 20' while angle brackets 64, 68 serve as support for T-support 60, holding it to the framing system of the building but allowing it movement in any horizontal direction, as will be described below.

Vertical faces 72, 76 are formed with horizontal slotted holes 104, 108 therein. The major dimensions of slotted holes 104, 108 are perpendicular to the major dimension of decking unit 20'. Vertical rib 88 of T-support 60 has a circular hole 112 formed therein that may be brought into registration with horizontal slotted holes 104, 108. A bolt 116 may then be inserted through slotted hole 104, circular hole 112 and slotted hole 108 and fastened with a nut 110 to secure T-support 60 between both angle brackets 64, 68 so that T-support 60 is able to slide between brackets 64, 68 in a direction perpendicular to deck span A-A in a controlled, limited manner when lateral forces on deck unit 20' exceed pre-engineered levels.

Horizontal faces 80, 84 of angle bracket 64, 68, respectively, have one or more slotted holes 120, 124 formed therein. The major dimensions of slotted holes 120, 124 are parallel to deck span A-A. A primary structural element 128, underlying angle brackets 64, 68, and which is part of the building's framing system but not part of frame element 56 or the present invention, has circular holes 132, 136 that may be brought into registration with slotted holes 120, 124 for receiving bolts (not shown) to secure frame element 56 to primary structural element 128. Angle brackets 64 and 68 of frame element 56 are then able to slide with respect to primary structural element 128 in a first direction, namely, parallel to deck span A-A. Support 60, meanwhile, is not fastened directly to primary structural element 128 and is free to move horizontally with respect to truss 128 in a second direction. Slotted holes 120, 124 allow angle brackets 64, 68 to move parallel to deck span A-A in the event lateral forces exceed pre-engineered levels.

Lateral forces may be applied from any direction and the corresponding horizontal force vectors that are parallel to and perpendicular to deck span A-A will move deck unit 20' and T-support 60, accordingly, as it is able to move both parallel to deck span A-A, because of the slotted connections between angle brackets 64, 68 and truss 128, and perpendicular to deck span A-A, because of the slotted connections between T-bar 60 and angle brackets 64, 68.

The two embodiments described above, an embodiment with slotted deck units and another embodiments with a slotted frame elements, may be combined to provide the third embodiment, having both slotted deck units between said slotted frame elements for additional response to lateral forces.

Those skilled in the art of diaphragm roof systems will appreciate that many substitutions and modifications can be made to the foregoing preferred embodiments without departing from the spirit and scope of the invention, which is defined by the appended claim.

What is claimed is:

1. A deck system for use with the framing system of a building, said deck system comprising:

plural deck units, each deck unit of said plural deck units having a major dimension, at least one flat, a first side lap and an opposing second side lap; and a frame element including a support to which said plural deck units are secured, bolts, and a bracket for securing said support to a framing system of a building, said support being secured to said framing system so that said support is slidable horizontally in a first direction with respect to said framing system, wherein said bracket includes a left angle bracket and a spaced-apart right angle bracket, said support being between said left angle bracket and said right angle bracket, and wherein said left bracket and said right bracket each have slotted holes formed therein, said support having holes there through, said slotted holes having a major dimension and a minor dimension, said major dimension of said slotted holes being parallel to said major dimension of said deck units, said slotted holes of said left and said right angle brackets being positionable in registration with said holes in said support for receiving said bolts through said holes of said support and said slotted holes in said left and right brackets so that said support is slidable in a controlled and limited way with respect to said left and said right angle brackets so that, when sufficient lateral force is applied to said plural deck units and said deck units are secured to said support, said support slides horizontally with respect to said brackets to relieve said lateral force.

2. The deck system as recited in claim 1, wherein said left and right angle brackets are secured to said framing system so that said left and right angle brackets slide horizontally in a second direction orthogonal to said first direction and with respect to said framing system.

3. The deck system of claim 1, wherein said second side lap of said each deck unit has slotted holes formed therein and is secured to a first side lap of an adjacent deck unit so that said each deck unit slides horizontally with respect to said adjacent deck unit when a horizontal force is applied to said deck system.

4. The deck system as recited in claim 1 wherein said support has a horizontal member and a vertical member, said vertical member being integrally joined to said horizontal member.

5. The deck system as recited in claim 4, wherein said horizontal member and said vertical member of said support form a T-shaped support.

6. A deck system for use with the framing system of a building, said deck system comprising:

plural deck units, each deck unit of said plural deck units having plural flats and plural channels, each flat of said plural flats being separated from an adjacent flat by a channel of said plural channels, said each deck unit having a first side lap and an opposing second side lap; and a frame element including a support to which said first and second side laps of said plural deck units are secured, said support having a vertical member and a horizontal member, a left bracket, and a right bracket, said vertical member of said support being between said left bracket and said right bracket and slidably secured thereto so that, when assembled, said plural deck units and said support move in a first direction with respect to said left and said right brackets when a sufficient horizontal force is applied to said plural deck units, and wherein said right and left brackets are slidably secured to a framing system of a building so that, when assembled, said plural deck units move in a second direction with respect to said framing system when said sufficient horizontal force is applied to said plural deck units.

7. The deck system as recited in claim 6, wherein said first and said second directions are mutually orthogonal.

8. The deck system as recited in claim 6, wherein each deck unit of said plural deck units is slidably secured to an adjacent deck unit.

9. The deck system as recited in claim 8 wherein said second side lap of said each deck unit has slotted holes, and wherein said deck system further comprises fasteners for fastening said second side lap to said first side lap of said each deck unit.

10. The deck system as recited in claim 9, wherein said fasteners include bushings that fit within said slotted holes of said second side lap of said each deck unit.

11. A deck system for use with the framing system of a building, said deck system comprising:

plural deck units, each deck unit of said plural deck units having a major dimension, at least one flat, a first side lap and an opposing second side lap; and a frame element including a support to which said plural deck units are secured, and a bracket for securing said support to a framing system of a building, said support being secured to said framing system so that said support is slidable horizontally in a first direction with respect to said framing system, wherein said bracket includes a left angle bracket and a spaced-apart right angle bracket, said support being between said left angle bracket and said right angle bracket, and wherein said left and said right angle brackets have slotted holes formed therein, wherein said slotted holes have a major dimension parallel to said major dimension of said plural deck units and a minor dimension perpendicular to said major dimension; and wherein said deck system further comprises bolts, said bolts passing through said slotted holes of said left and right bracket and into said framing system of said building so that, when sufficient lateral force is applied to said plural deck units and said left and right angle brackets slide with respect to said framing system.

12. The deck unit as recited in claim 11, wherein said at least one flat is two flats, and wherein said each deck unit has one channel formed between said two flats.

13. The deck unit as recited in claim 11, wherein said fasteners have non-threaded shoulders, said non-threaded shoulders having diameters slightly smaller than said minor dimension of said slotted holes.

14. The deck unit as recited in claim 11, wherein said fasteners further include bushings, said bushings having a smaller diameter than said minor dimension of said slotted holes.

* * * * *